US011092299B2

(12) United States Patent
Weddendorf et al.

(10) Patent No.: US 11,092,299 B2
(45) Date of Patent: Aug. 17, 2021

(54) SOLAR LIGHT ASSEMBLY

(71) Applicant: Green Light Optics LLC, Huntsville, AL (US)

(72) Inventors: Bruce Weddendorf, Huntsville, AL (US); Shawn Estes, Huntsville, AL (US); Benjamin Payment, Huntsville, AL (US)

(73) Assignee: GREEN LIGHT OPTICS LLC, Huntsville, AL (US)

( * ) Notice: Subject to any disclaimer, the term of this patent is extended or adjusted under 35 U.S.C. 154(b) by 0 days.

(21) Appl. No.: 17/105,893

(22) Filed: Nov. 27, 2020

(65) Prior Publication Data

US 2021/0156534 A1 May 27, 2021

Related U.S. Application Data

(60) Provisional application No. 62/941,218, filed on Nov. 27, 2019.

(51) Int. Cl.

| | |
|---|---|
| ***F21S 9/03*** | (2006.01) |
| ***F21V 21/08*** | (2006.01) |
| ***F21V 17/16*** | (2006.01) |
| ***G09F 13/42*** | (2006.01) |
| ***G09F 13/02*** | (2006.01) |
| ***F21V 23/04*** | (2006.01) |
| ***F21Y 115/10*** | (2016.01) |

(52) U.S. Cl.

CPC ..... *F21S 9/037* (2013.01); *F21V 17/16* (2013.01); *F21V 21/08* (2013.01); *F21V 23/04* (2013.01); *G09F 13/02* (2013.01); *G09F 13/42* (2013.01); *F21Y 2115/10* (2016.08)

(58) Field of Classification Search

CPC .... F21S 9/037; G09F 13/02; G09F 2013/049; F21V 21/08

See application file for complete search history.

(56) References Cited

U.S. PATENT DOCUMENTS

| | | | | |
|---|---|---|---|---|
| 5,101,329 | A * | 3/1992 | Doyle | F21S 9/037 362/183 |
| 6,299,325 | B1 * | 10/2001 | Cathel | G09F 13/04 362/183 |
| 7,357,527 | B2 * | 4/2008 | Meyers | G09F 13/02 362/183 |
| 7,422,348 | B1 * | 9/2008 | Yates, II | G09F 13/02 362/184 |
| D616,137 | S * | 5/2010 | Bucher | D26/72 |
| 8,631,597 | B2 * | 1/2014 | Delorenzo | G09F 7/22 40/479 |
| 9,470,385 | B1 * | 10/2016 | Ploucher | B63B 59/02 |
| 9,805,628 | B2 * | 10/2017 | Pierson | G09F 13/02 |

(Continued)

*Primary Examiner* — William N Harris

(74) *Attorney, Agent, or Firm* — Angela Holt; Bradley Arant Boult Cummings LLP

(57) ABSTRACT

A solar light assembly is configured for illuminating a corrugated sign. The assembly comprises a solar panel, a battery, and a printed circuit board electrically connected to the battery and to the solar panel. An LED light is disposed on the printed circuit board, which is curved to direct the light onto a printed surface of the sign. A sign attachment component attaches the assembly to the corrugated sign. The sign attachment component may be one or more spears configured to be inserted into flutes of the corrugated sign.

20 Claims, 10 Drawing Sheets

(56) References Cited

U.S. PATENT DOCUMENTS

| | | | | |
|---|---|---|---|---|
| 2006/0164827 | A1* | 7/2006 | Minewiser | F21S 9/037 362/183 |
| 2007/0017131 | A1* | 1/2007 | Visotcky | G09F 13/02 40/559 |
| 2007/0193196 | A1* | 8/2007 | Pernici | G09F 7/18 52/714 |
| 2016/0305079 | A1* | 10/2016 | Fakhari | G09F 13/02 |
| 2018/0330643 | A1* | 11/2018 | Ross | G09F 13/005 |

* cited by examiner

SOLAR LIGHT ASSEMBLY

REFERENCE TO RELATED APPLICATIONS

This application claims priority to U.S. Provisional Patent Application No. 62/941,218, filed on Nov. 27, 2019 and titled "Solar Light," which is incorporated herein by reference.

FIELD OF INVENTION

This disclosure relates generally to signage and to illumination. Uses for this assembly may include, but are not limited to: illuminating a sign; illuminating a corrugated sign; attracting attention to a sign; beautifying a sign; using a solar light assembly; and assembling a solar light assembly.

BACKGROUND AND SUMMARY

In the fields of signage and of illumination, signs are useful for communicating information. But signs might not communicate effectively in environments that are dark. So it is sometimes desirable to illumine a sign that is in a dark environment.

One common type of sign is a corrugated sign, i.e., a sign having two print surfaces separated by a layer of flutes or corrugations. Corrugated signs are often made of plastic, paper, cardboard, or metal. Corrugated signs are often used as political-campaign signs, realtor signs, garage-sale signs, and similar signs constructed of a corrugated-plastic panel. Corrugated signs are often smooth and lightweight. So it is sometimes difficult to attach a light to a corrugated sign.

Signs are sometimes used in outdoor environments—for example, in environments that alternate between dark and light. In such an environment, it may be desirable to illumine a sign only when the environment is dark.

Consequently, an opportunity exists to make signage more effective by providing a light assembly for illuminating corrugated signs, especially if that light is a solar light, is lightweight, and is attachable to a corrugated sign.

The present disclosure describes a solar light assembly configured for illuminating a corrugated sign. The assembly comprises a solar panel, a battery, and a printed circuit board electrically connected to the battery and to the solar panel. An LED light is disposed on the printed circuit board, which is curved to direct the light onto a printed surface of the sign. A sign attachment component attaches the assembly to the corrugated sign. The sign attachment component may be one or more spears configured to be inserted into flutes of the corrugated sign.

BRIEF DESCRIPTION OF THE DRAWINGS

The following drawings are attached to—and form a portion of—this disclosure.

DEFINITIONS

Figure 1:
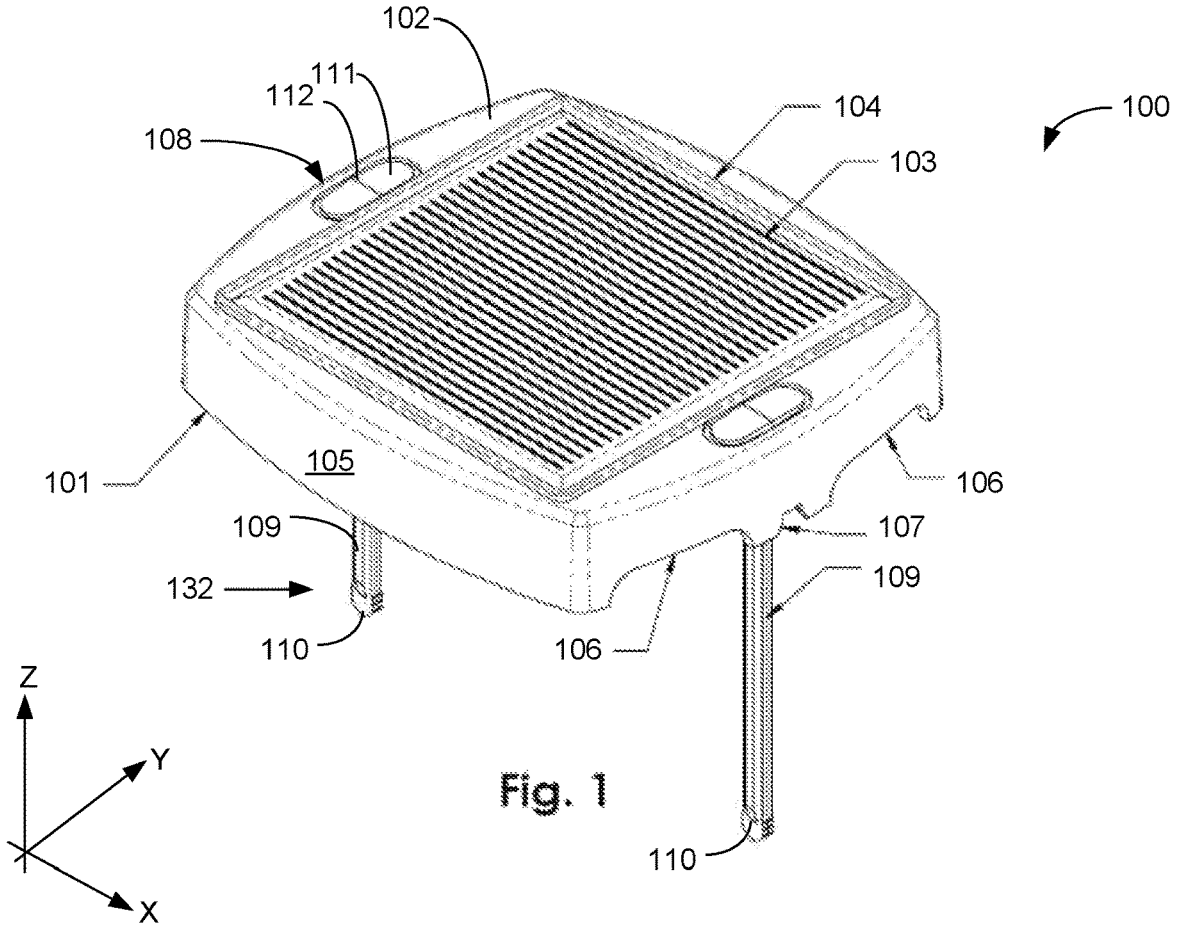
FIG. 1 is a top perspective view of a solar light assembly in accordance with an embodiment of the present disclosure.

Unless otherwise defined, all terms (including technical and scientific terms) in this disclosure have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly defined otherwise in this disclosure. For brevity or clarity, well known functions or constructions may not be described in detail.

The terms "about" and "approximately" shall generally mean an acceptable degree of error or variation for the quantity measured in light of the nature or precision of the measurements. Typical, exemplary degrees of error or variation are within 20 percent (%), preferably within 10%, more preferably within 5%, of a given value or range of values. Numerical quantities given in this description are approximate unless stated otherwise, meaning that the term "about" or "approximately" can be inferred when not expressly stated.

The terminology used throughout the disclosure is for the purpose of describing particular embodiments only and is not intended to be limiting. The singular forms "a," "an," and "the" are intended to include the plural forms as well, unless the context clearly indicates otherwise.

The terms "first," "second," and the like are used to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the disclosure. Likewise, terms like "top" and "bottom"; "front" and "back"; and "left" and "right" are used to distinguish certain features or elements from each other, but it is expressly contemplated that a top could be a bottom, and vice versa.

The term "consisting essentially of" means that, in addition to the recited elements, what is claimed may also contain other elements (steps, structures, ingredients, components, etc.) that do not adversely affect the operability of what is claimed for its intended purpose as stated in this disclosure. This term excludes such other elements that adversely affect the operability of what is claimed for its intended purpose as stated in this disclosure, even if such other elements might enhance the operability of what is claimed for some other purpose.

The terms "connected to," "in connection with," "in communication with," "connecting", and "electrically connected to" include any suitable connection or communication, including mechanical connection, electrical connection (e.g.: one or more wires), or signal-conducting channel (e.g., Bluetooth®, Near-Field Communication (NFC), or other inductive coupling or radio-frequency (RF) link).

It is to be understood that any given elements of the disclosed embodiments of the invention may be embodied in a single structure, a single step, a single substance, or the like. Similarly, a given element of the disclosed embodiment may be embodied in multiple structures, steps, substances, or the like.

The following description illustrates and describes the processes, machines, manufactures, compositions of matter, and other teachings of the present disclosure. The disclosure shows and describes only certain embodiments of the processes, machines, manufactures, compositions of matter, and other teachings disclosed; but as mentioned above, it is to be understood that the teachings of the present disclosure are capable of use in various other combinations, modifications, and environments and are capable of changes or modifications within the scope of the teachings of this disclosure, commensurate with the skill and knowledge of a person having ordinary skill in the relevant art. The embodiments described are further intended to explain certain best modes known of practicing the processes, machines, manufactures, compositions of matter, and other teachings of the disclosure and to enable others skilled in the art to utilize the teachings of the disclosure in such, or other, embodiments and with the various modifications required by the particular applications or uses. Accordingly, the processes, machines, manufactures, compositions of matter, and other teachings of the present disclosure are not intended to limit the exact embodiments and examples disclosed herein. Any section headings herein are provided only for consistency with the suggestions of 37 C.F.R. § 1.77 or otherwise to provide organizational cues. These headings shall not limit or characterize the invention(s) set forth herein.

DETAILED DESCRIPTION

A solar light assembly and methods for assembling and for using a solar light assembly have been developed and are described. The drawings generally disclose embodiments of the system and methods for use with corrugated signs. Variations could be advantageously used in connection with many types of signs or environments. In other words, the teachings of this disclosure may be advantageously used with other types of signs, including billboards or art.

FIG. 1 is a top perspective view of an embodiment of a solar light assembly 100. The solar light assembly 100 may also be referred to herein as an "assembly" 100. The description herein may sometimes employ the terms "longitudinal," "transverse," and "vertical," which may refer to a trio of directions or axes mutually substantially orthogonal and may substantially correspond, for example, to the directions or axes "x," "y," and "z," respectively, indicated on the axis in FIG. 1.

The solar light assembly 100 comprises a housing 101. The housing 101 may be made of any suitable material, such as plastic (e.g., injection-molded plastic). The housing 101 has a top surface 102 and a skirt 105. In the illustrated embodiment, the top surface 102 is substantially flat or planar.

In some embodiments of the solar light assembly 100, the housing 101 may be illuminated. One or more lights (e.g., LEDs) (not specifically shown) may illuminate the inside of the housing 101. In some embodiments, the housing 101 may be made of a translucent plastic. The housing 101 may glow when illuminated by lights from within the housing 101. The housing 101 may be made in various colors and opacities. In some embodiments, the shape of the housing 101 (e.g., its top profile or side profile) may be formed of various shapes (e.g., logos or emblems). In some embodiments, various shapes of the housing 101 may be achieved by the use of accessories, such as snap-on upgrades (not shown).

In the illustrated embodiment, the housing 101 is configured to receive a sign-attachment component 132. The housing 101 comprises at least one slot 108 configured to receive the sign-attachment component 132. In the illustrated embodiment, the sign-attachment component 132 is a separate piece that fits into the housing 101 as shown. In other embodiments, the sign-attachment component 132 may be integral to the housing 101. The sign-attachment component 132 may be any suitable sign-attachment component configured to be attached to a sign (e.g., to an upper edge (not shown in FIG. 1) of a corrugated sign (not shown in FIG. 1)). In some embodiments, a sign-attachment component 132 may comprise clips, fasteners, or any other suitable mechanism or component.

In some embodiments, the sign-attachment component 132 may comprise at least one spear 109. In the illustrated embodiment, the sign-attachment component 132 comprises two spears 109. The at least one spear 109 is configured to be inserted into a flute (not shown) of a corrugated sign (not shown), as further discussed herein. For example, the spear 109 may be a component which is longer along the vertical direction than along the transverse and longitudinal directions when oriented to be received by the housing 101. Some embodiments of the spear 109 may comprise components for securing the spear 109 within a flute, for example barbs, teeth, adhesives, rough patches, or friction pads.

The spear 109 comprises a spear tip 110 disposed at a lower end of the spear 109. The spear tip 110 may be barbed or ribbed such that it resists removal once inserted into the sign. The spear 109 comprises at least one spear tab 111 disposed at an upper end of the spear 109. The spear tab 111 is be configured to prevent the spear 109 from moving completely through the slot 108, thereby retaining the spear 109 in the slot 108. The spear tab 111 may be a flat plate or blade which is larger along the longitudinal and transverse directions than along the vertical direction when oriented to be received by the slot 108 (e.g., a wide, thin oblong or oval). The spear tab 111 may comprise a center portion 112.

In some embodiments, one or more cutouts 106 (e.g., four cutouts 106) may be formed in the skirt 105 of the housing 101. The cutouts 106 help to prevent the housing 101 from shadowing the illumination from the assembly being projected onto the sign.

In the illustrated embodiment, the housing 101 comprises a notch 107 on opposed sides of the skirt 105. The notch 107 fits over an upper edge (not shown in FIG. 1) of a sign (not shown in FIG. 1) when the assembly 100 is installed on the sign, as further discussed herein. The notch 107 may enhance, contribute to, or bolster the capability of the sign-attachment component 132 to attach the solar light assembly 100 to the sign. In the illustrated embodiment, the notch 107 is tapered to ease installation of the assembly 100 onto the sign. A user may press the notch 107 down over the upper edge of the sign when the solar light assembly 100 is in use. The notch 107 may deform the sign somewhat, depending on the thickness of the sign, forming an interference fit. The notch 107 may thereby further connect the solar light assembly 100 to the sign. The notch 107 may thereby prevent the solar light assembly 100 from wobbling in the longitudinal-transverse plane relative to the sign.

In the illustrated embodiment, the slot 108 is an opening that extends through the top surface 102. The slot 108 is configured to receive the spear 109—for example, by a user inserting the spear tip 110 into the slot 108 and pushing the spear 109 at least partially through the slot 108. In the illustrated embodiment, the spear 109 and the slot 108 both have longitudinal dimensions which are different from their transverse dimensions. Such a configuration may prevent misalignment or misorientation of the spear 109 and slot 108 with respect to each other when the slot 108 receives the spear 109. In this regard, the spear 109 and the slot 108 are wider in the longitudinal direction than in the transverse direction, when oriented for the spear 109 to be received by the slot 108.

The solar light assembly 100 comprises a solar panel 103. In the illustrated embodiment, the solar panel 103 is substantially surrounded by a raised rib 104. The raised rib 104 is integrally molded with the housing 101 in this embodiment. The raised rib 104 extends vertically above the solar panel 103. In some embodiments, the raised rib 104 may protect the solar panel 103.

Figure 2:
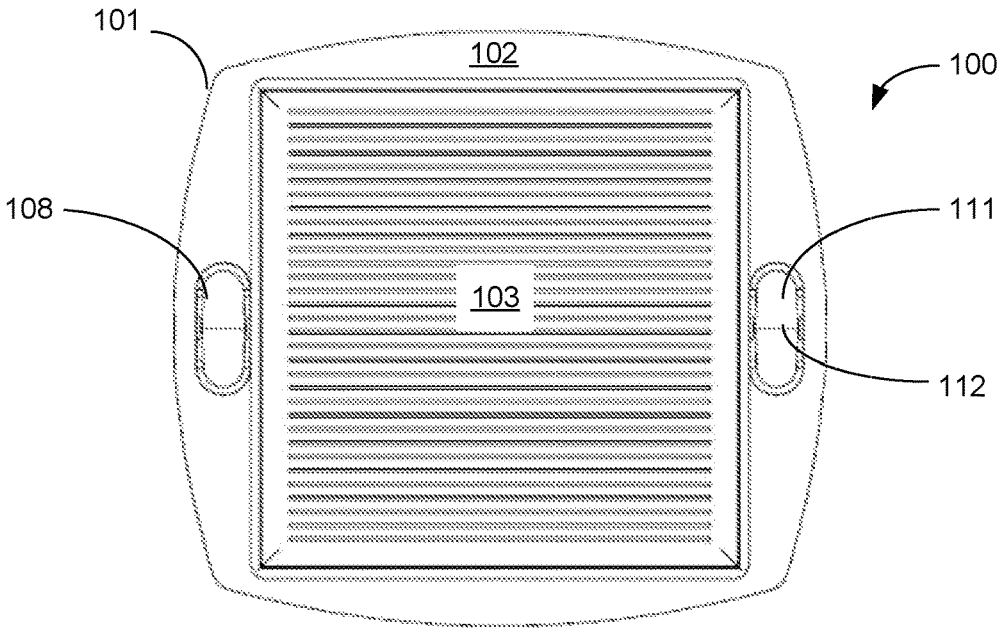
FIG. 2 is a top view the solar light assembly of FIG. 1.

FIG. 2 is a top view of the solar light assembly 100 shown in FIG. 1. FIG. 2 shows that the housing 101 may have a top profile which is essentially rectangular or square. The housing 101 may have a top profile with sides that are curved or rounded. The top profile of the housing 101 may have at least one line of symmetry. For example, the housing 101 may be symmetrically disposed on a corrugated sign (not shown), as further discussed herein.

Figure 3:
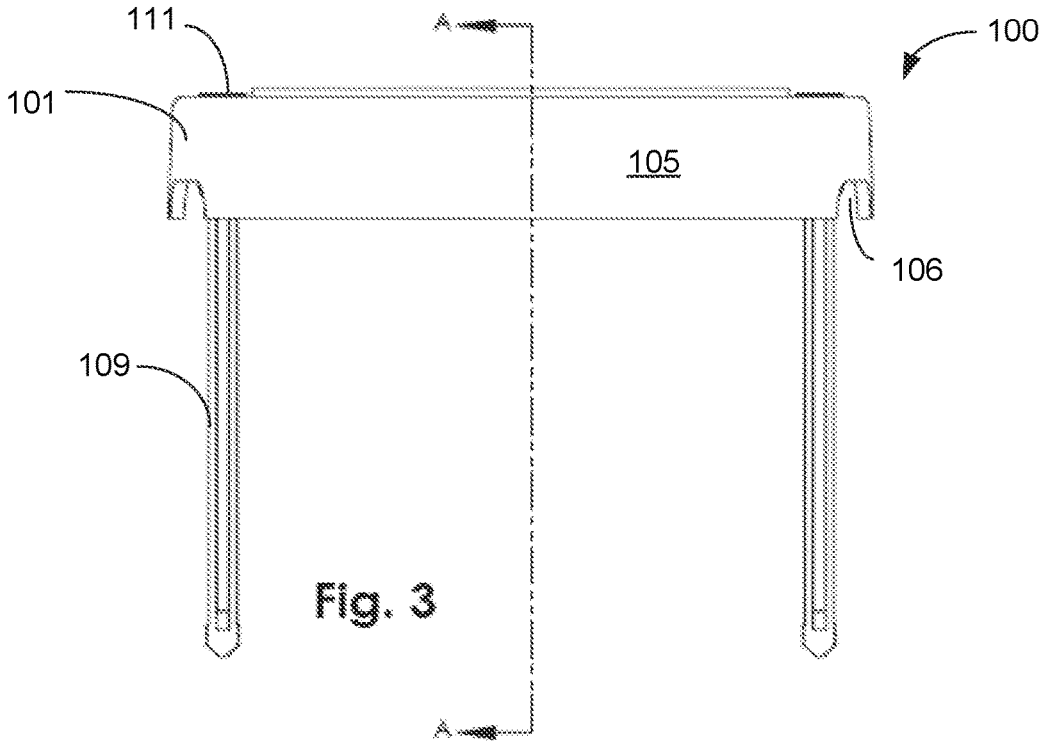
FIG. 3 is a side view of the solar light assembly of FIG. 1.

FIG. 3 is a side view of the solar light assembly 100 shown in FIG. 1. As shown, the housing 101 has a side profile which is essentially rectangular. The side profile of the housing 101 may have at least one line of symmetry. For example, in the illustrated embodiment the housing 101 is symmetrically disposed on a corrugated sign (not shown in FIG. 3). The top surface 102 of the housing is substantially flat in this embodiment. The bottom edge of the skirt 105 is substantially straight.

Figure 4:
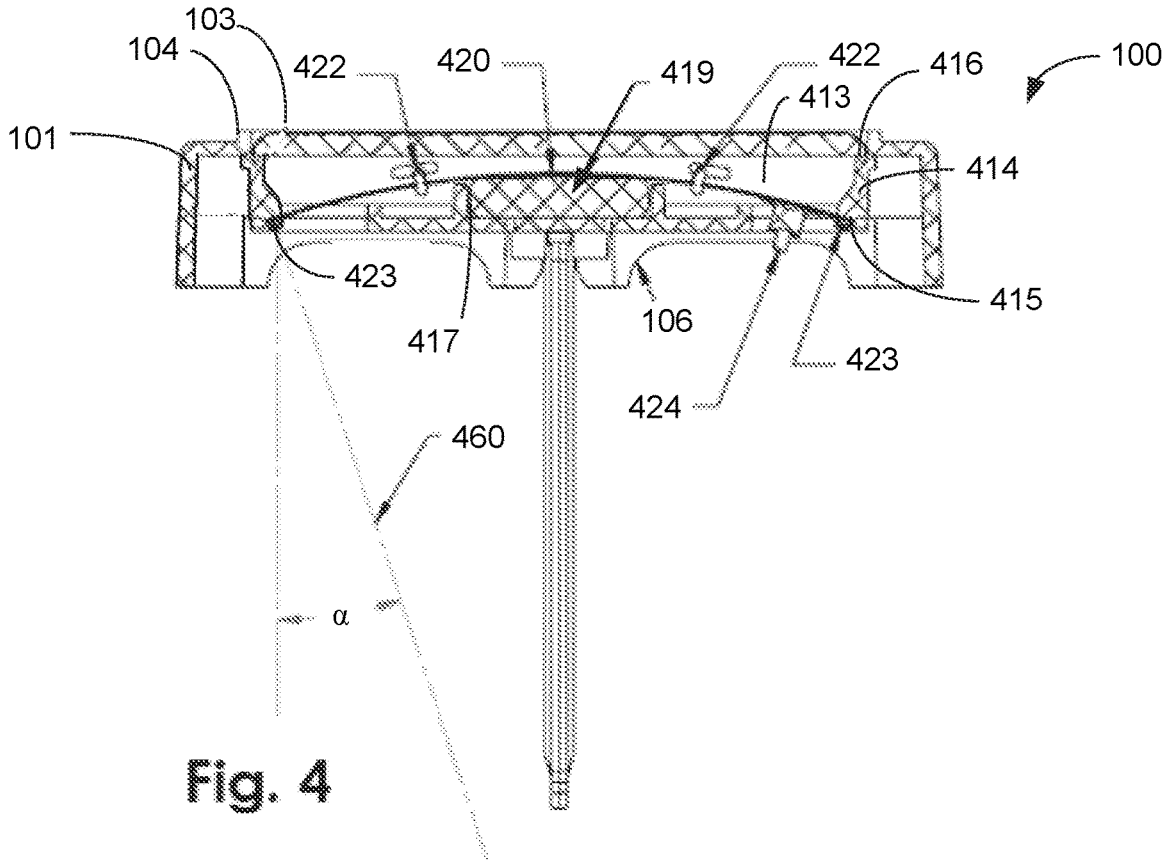
FIG. 4 is a cross-sectional view of the solar light assembly of FIG. 3, taken along lines A-A of FIG. 3.

FIG. 4 is a cross-sectional view of the solar light assembly 100 of FIG. 3, taken along lines A-A of FIG. 3. The housing 101 is configured to receive a printed circuit board ("PCB") 420 comprising at least one light 423. In the illustrated embodiment, the at least one light 423 is a light-emitting diode ("LED"). The solar light assembly 100 is configured for the light 423 to illuminate one or more surfaces of a sign, e.g., one or both print surfaces (not shown) of a corrugated sign (not shown), as further discussed herein.

Some embodiments of the solar light assembly 100 may use lenses and/or reflectors (not specifically shown) to help direct illumination from the light 423 for illumination of the sign. In some embodiments, a plastic light pipe or other lens (not specifically shown) may be mounted over the light 423 to direct its illumination. In some embodiments, the inside of the housing 101 may be polished (e.g., molded against a polished surface of a tool), which may increase its reflectivity. In some embodiments, the inside of the housing 101 may be coated with reflective paint or plating. In some embodiments, the inside of the housing 101 may be shaped to reflect illumination in a desired pattern, for example to spread illumination more evenly across a sign. In some embodiments, one or more cutouts 106 (e.g., four cutouts 106) may be formed in the skirt 105 of the housing 101. The cutouts 106 may allow illumination from the lights 423 to shine onto a sign extending away from the solar light assembly 100 positioned near the center (not shown on FIG. 4) of the sign and toward each vertical edge (not shown on FIG. 4) of the sign. The cutouts 106 may allow illumination from the lights 423 to reach the sign either directly or after one or more reflections from the inside of the housing 101.

In the illustrated embodiment, the electrical system comprises a solar panel 103, a battery 419, and a printed circuit board ("PCB") 420. The solar panel 103 is electrically connected the PCB 420 and the battery 419. The PCB 420 is electrically connected the solar panel 103 and the battery 419. The battery 419 is a rechargeable battery in the illustrated embodiment, and the solar panel 103 is configured to charge the battery 419 during a time when the solar panel 103 is illuminated by light from the environment. The battery 419 may be configured to provide power to the light 423, for example by being electrically connected to the light 423 or by being electrically connected to the PCB 420 which may in turn be electrically connected to the light 423. In some embodiments, the light 423 may be electrically connected to both the battery 419 and the PCB 420.

The solar light assembly 100 may be configured for the light 423 to turn on automatically when the environment is dark, for example during the night or during low illumination. The solar light 100 may be configured for the light 423 to turn off automatically when the environment is light, for example during the day. In some embodiments, the light 423 may be controlled by determining the lightness or darkness of the environment with a photodiode or photoresistor (not specifically shown). In some embodiments, the light 423 may be controlled by determining the lightness or darkness of the environment using the voltage generated by the solar panel 103 itself.

As shown in FIG. 4, the housing 101 comprises a cavity 413 having a cavity wall 414 and configured to receive the battery 419 and the PCB 420. The cavity 413 comprises a depression in the housing 101 (e.g., a substantially central depression in the top surface 102 of the housing 101). The cavity 413 is dimensioned to fit within the housing 101. The cavity 413 has a top profile similar to and smaller than the top profile of the housing 101. In the illustrated embodiment, the cavity 413 comprises a battery recess 417 configured to receive the battery 419.

The PCB 420 may be any suitable printed circuit board. The PCB 420 may contain substantially all the electronic devices and circuits. The PCB 420 is designed to be flexed by a force applied by a user or assembling machine, as further discussed herein.

In some embodiments at least one wire pair 422 may be attached to the PCB 420 (e.g., by soldering). In some embodiments a wire pair 422 may electrically connect the PCB 420 to the solar panel 103. In some embodiments a wire pair 422 may electrically connect the PCB 420 to the battery 419. Wire pairs 422 may be soldered onto the PCB 420 before the components are assembled into the housing 101.

In the illustrated embodiment, the cavity wall 414 comprises a cavity step 416 configured to support the solar panel 103. The cavity step 416 may be configured to support the solar panel 103 proximate to or substantially in the plane of the top surface 102 of the housing 101. The cavity step may provide a resting place for the back side of the solar panel 103 around the edge of the solar panel 103. In some embodiments, the solar panel 103 may be secured to the cavity step 416 by glue or other adhesive. In some embodiments, the solar panel 103 may be secured to the cavity step 416 by separate threaded or snap-fit fasteners, or by co-molded snap features that could contain the solar panel 103 when it is inserted into the cavity by springing over the edge of the solar panel 103.

In the illustrated embodiment, a perimeter of the cavity step 416 is substantially surrounded by the raised rib 104. The raised rib 104 is integrally molded with the housing 101. The raised rib 104 extends vertically above the solar panel 103 when the solar panel 103 is supported by the cavity step 416. In some embodiments, the raised rib 104 may protect the solar panel 103.

In the illustrated embodiment the cavity wall 414 comprises at least one retaining feature 415 configured to retain the PCB 420 in the cavity 413. The retaining feature 415 may be any suitable retaining feature, for example a clip, a protrusion, a snap, an overhang, or any other feature configured to retain the PCB 420 in the cavity 413. In FIG. 4 the retaining features 415 are protrusions of the cavity wall 414. The retaining feature 415 is configured to retain the PCB 420 in a flexed (i.e., curved or bent) state with a PCB flex angle $\alpha$. The angle $\alpha$ in this instance is the angular distance from a centerline of illumination 460 of a light 423 to the vertical. In FIG. 4, the cavity wall 414 comprises a pair of retaining features 415 disposed oppositely from each other across the transverse direction. The retaining feature 415 might not extend along the entire longitudinal length of the cavity wall 414.

In one embodiment, the PCB flex angle $\alpha$ is about 18 degrees, and in other embodiments may be between approximately 5 degrees and approximately 45 degrees. In some embodiments, the PCB flex angle $\alpha$ may be configured to direct illumination from the light 423 onto a print surface (not shown) of a corrugated sign (not shown). For example, the flexed stated of the PCB 420 may cause the centerline of illumination 460 from a light 423 to project onto a print surface of a corrugated sign.

Circuited traces on the PCB 420 may be kept in compression on the concave side of the PCB 420. This may ensure that the PCB flex angle $\alpha$ does not jeopardize the continuity of any electrical circuitry.

As shown in FIG. 4, the retaining feature 415 may be configured to retain the PCB 420 in a flexed state with a PCB flex angle $\alpha$. The PCB 420, the retaining feature 415, the battery 419, and (in some embodiments) the battery recess 417 may be mutually configured such that the contact force of the retaining feature 415 retaining the PCB 420 in a flexed state may be transmitted by the PCB 420 as a substantially downwardly vertical force on the battery 419. The resultant force assists in retaining the battery 419 in a desired location. For example, the force may aid in retaining the battery 419 in the battery recess 417. By this method, both the battery 419 and the PCB 420 are secured without the use of fasteners or of bonding, simply by the configuration of the housing 101, PCB 420, battery 419, and retaining feature 415 and by the elasticity of the PCB 420 as a spring to retain the electrical system. After the PCB 420 is in place, a user or assembling machine may place the solar panel 103 onto the cavity step 416.

Either the at least one light 423, or the battery 419, or both may be electrically connected to a switch 424. In the illustrated embodiment the switch 424 is positioned on the PCB 420 on the lower side of the PCB 420 and accessible below the housing 101. The switch 424 is configured to turn the at least one light 423 on and/or off when the battery 419 is at least partially charged. The switch 424 may be configured to switch off the battery 419 (and thus the lights 423) from the primary circuit (not specifically shown on FIG. 4). In various embodiments, the switch 424 may be any suitable switch. In the illustrated embodiment, the switch 424 is a manual switch configured to be controlled by a user. In some embodiments, the switch 424 may be a timer switch. In some embodiments, the switch 424 may be a light-activated switch. In some embodiments the switch 424 may be a motion-sensor activated switch. In some embodiments, the switch 424 disables the light 423 but does not prevent charging. In this regard, charge and overcharge circuits may be independent of the switch 424.

Figure 5:
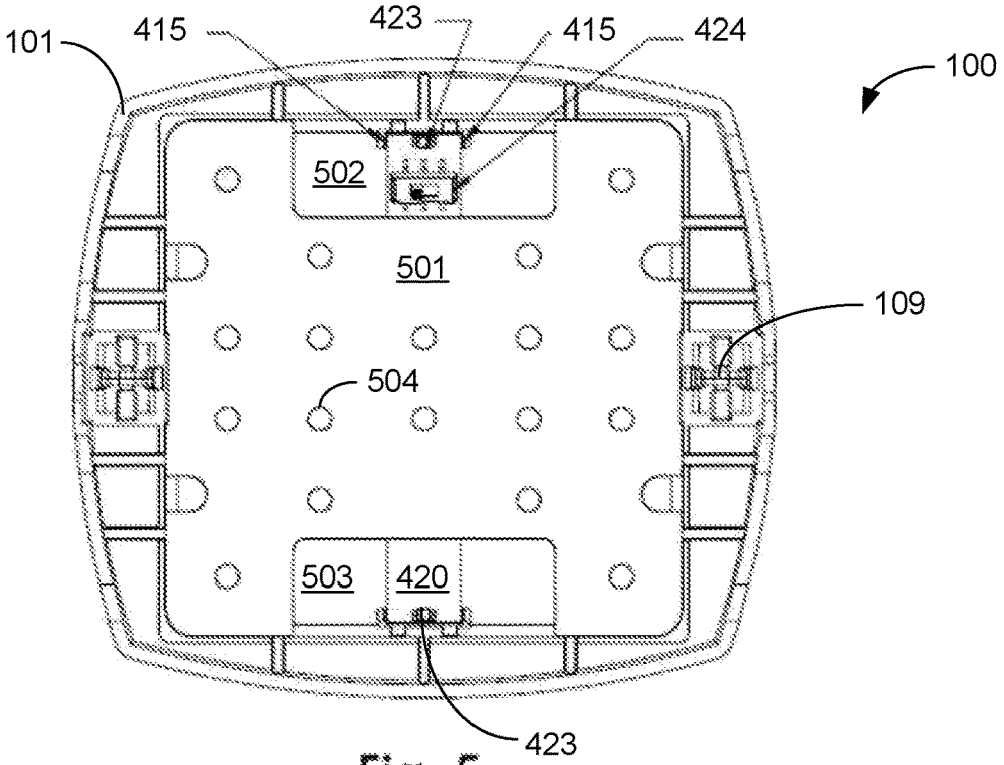
FIG. 5 is a bottom view of the solar light assembly of FIG. 1.

FIG. 5 is a bottom view of the solar light assembly 100 shown in FIG. 1. A bottom plate 501 is affixed to the underside of the housing 101 in the illustrated embodiment. A first opening 502 in the bottom plate 501 provides access to the switch 424. In this regard, the first opening 502 is disposed under the switch 424 and allows the user to actuate the switch 424 without removing the bottom plate 501. A second opening 503 is opposite the first opening 501 on the bottom plate 501. A portion of the PCB can be seen and accessed through the second opening 502. The lights 423 (two lights 423 are shown in FIG. 5) shine through the first opening and the second opening. In the illustrated embodiment, a plurality of holes 504 through the bottom plate 501 help to prevent moisture from collecting within the assembly. The assembly as illustrated with two lights 423 allows the lights to shine on both sides of a two-sided sign. In other embodiments, the assembly may be essentially halved to illuminate a single surface, for example, a sign against a wall.

Figure 6:
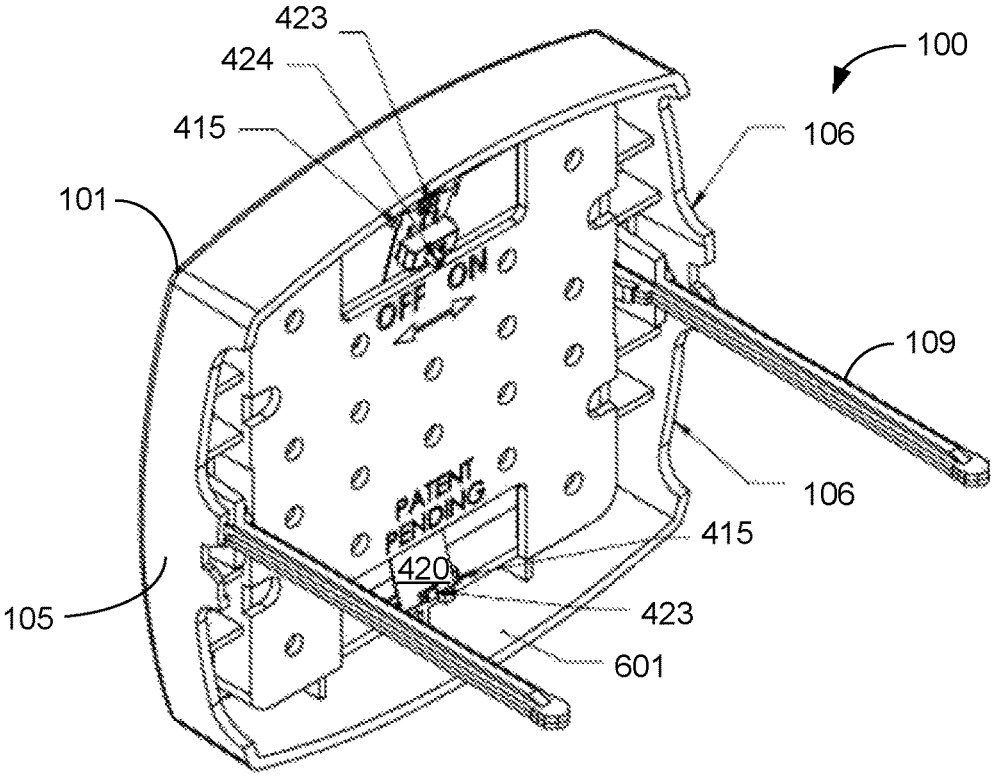
FIG. 6 is a bottom perspective view of the solar light assembly of FIG. 1.

FIG. 6 is a bottom perspective view of the solar light assembly 100 shown in FIG. 1. The two spears 109 extend downwardly through the housing 101 as shown. The PCB 420 is shown as flexed as discussed herein, the flexing of the PCB causing the lights 423 to be directed to shine on the sign (not shown). An inside wall 601 of the housing 101 may be polished to aid in reflecting light from the lights 423.

Figure 7:
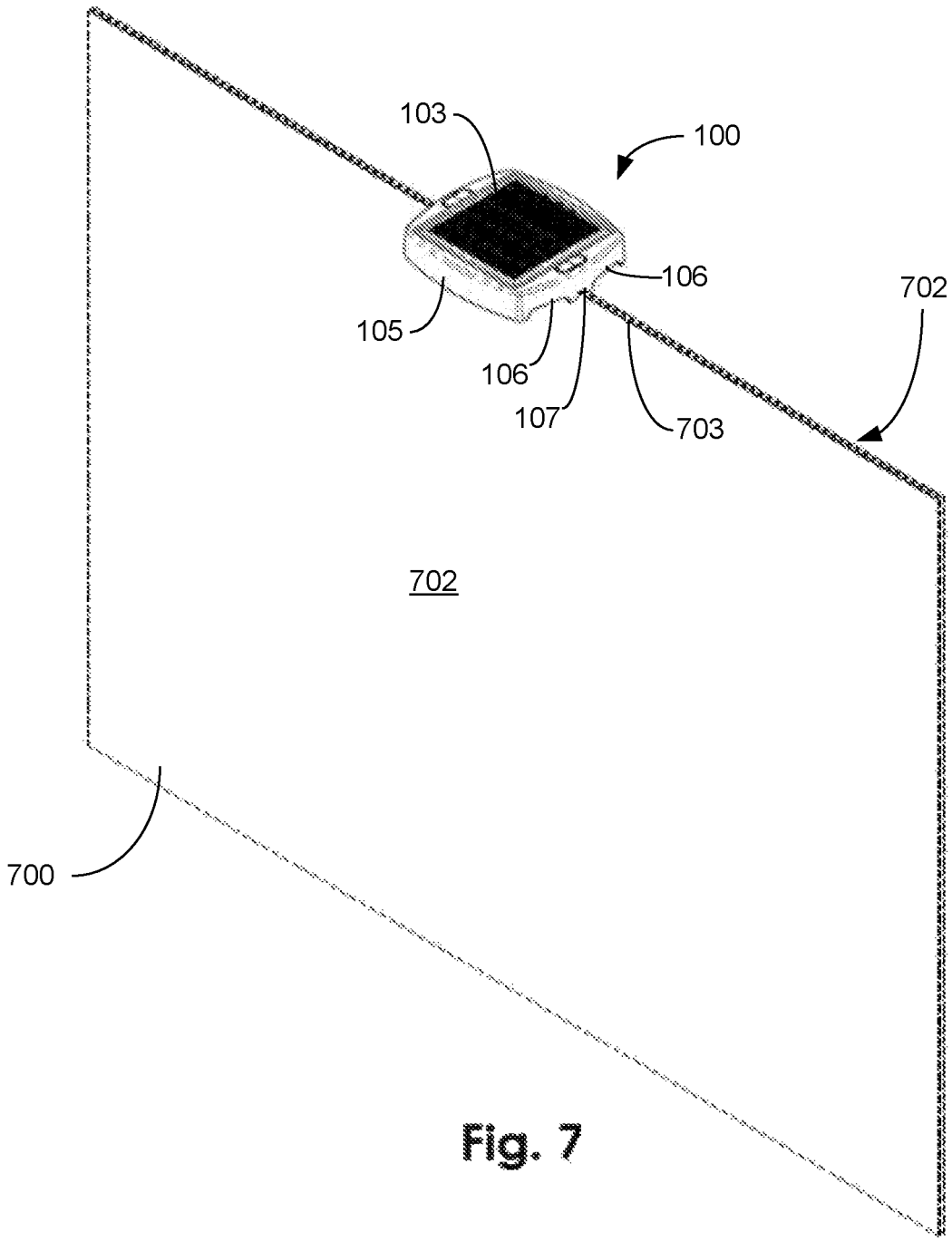
FIG. 7 is a top perspective view of a solar light assembly installed on a sign, in accordance with an embodiment of the present disclosure.

FIG. 7 is a top perspective view of the solar light assembly 100 shown in FIG. 1 as attached to a corrugated sign 700. In some embodiments, the inside of the housing 101 may be shaped to reflect illumination from the light 423 in a desired pattern, for example to spread illumination more evenly across an upper region of the corrugated sign 700. The cutouts 106 may allow illumination from the lights 423 to shine onto an upper area of the corrugated sign 700 extending away from the solar light assembly 100 positioned near the center of the sign and toward each vertical edge of the sign. The cutouts may allow illumination from the lights 423 to reach the sign either directly or after one or more reflections from the inside of the housing 101.

In some embodiments, the PCB flex angle $\alpha$ (FIG. 4) may be configured to direct illumination from the light 423 (FIG. 4) onto a printed surface 702 of the corrugated sign 700. For example, the flexed state of the PCB (not shown in FIG. 7) may cause the centerline of illumination 460 (FIG. 4) to project onto a print surface 702 of a corrugated sign 700. In the illustrated embodiment, the housing 101 comprises the notch 107 on opposed sides of the skirt 105. The notch 107 fits over the upper edge 703 of a corrugated sign 700 when the assembly 100 is installed on the sign.

Figure 8:
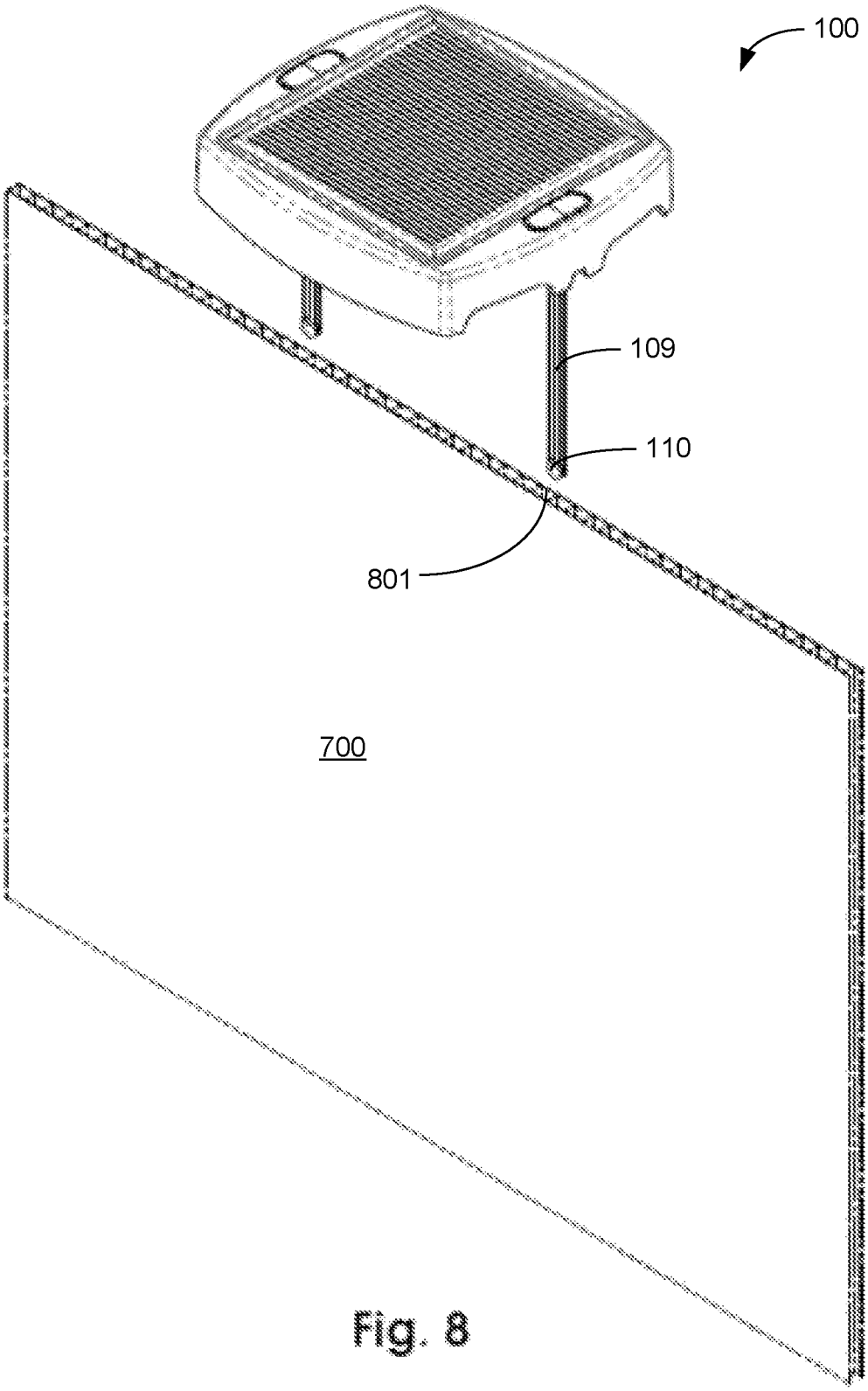
FIG. 8 is a top perspective view of a solar light before installation onto a sign.

FIG. 8 is a top perspective view of the solar light assembly 100 shown in FIG. 1 ready to be attached to the corrugated sign 700. The sign 700 comprises a plurality of flutes 801 or openings that extend generally vertically down the sign. The spears 109 are configured to frictionally fit within the flutes 801. In some embodiments, the spears 109 may be flexible or elastic enough to allow the spears 109 to be flexed or rotated in a vertical-longitudinal plane. That may allow a user to adjust the spears 109 to match the spacing of flutes 801 of the corrugated sign 700 (which spacing may vary from sign to sign, depending on the manufacturer among other factors).

Figure 9:
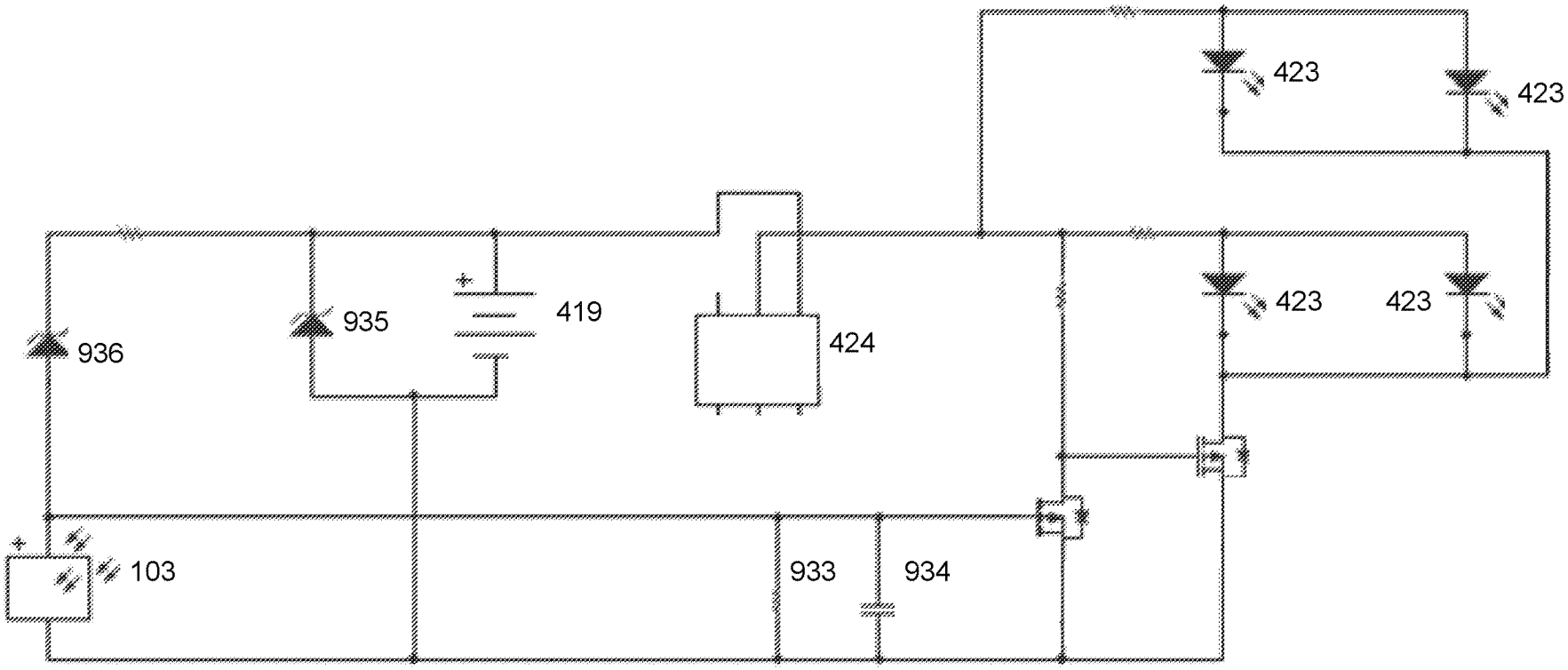
FIG. 9 is a schematic of an exemplary electrical circuit of a solar light assembly.

FIG. 9 is an electrical schematic of an embodiment of a solar light assembly 100. In some embodiments, the lights 423 may be controlled by determining the lightness or darkness of the environment with a photodiode or photoresistor (not specifically shown). In some embodiments, the light 423 may be controlled by determining the lightness or darkness of the environment using the voltage generated by the solar panel 103 itself. An analog resistor-capacitor ("RC") timer 934 may be used on the switching circuit 933 to prevent flickering during low-light scenarios while transitioning between on and off states of the lights 423 or battery 419. Note that the schematic of FIG. 9 shows four (4) lights 423. In some embodiments, additional lights 423 are included for backlighting the housing. In this regard, some embodiments of the housing may include translucent plastic, facilitating the use of colored lights.

In some embodiments of the PCB 420, a blocking diode 936 may prevent battery discharge when the solar panel 103 is not generating power. The battery 419 may have one or both of over-voltage protection and under-voltage protection. In some embodiments, a Zener diode 935 may match the full charge of the battery 419 (e.g., nominally 4.2 volts direct current), thereby providing over-voltage and overcharge protection. A Zener diode 936 and associated resistor 937 may be configured to dissipate all the power of the solar panel 103 if the battery 419 is already substantially fully charged.

Figure 10:
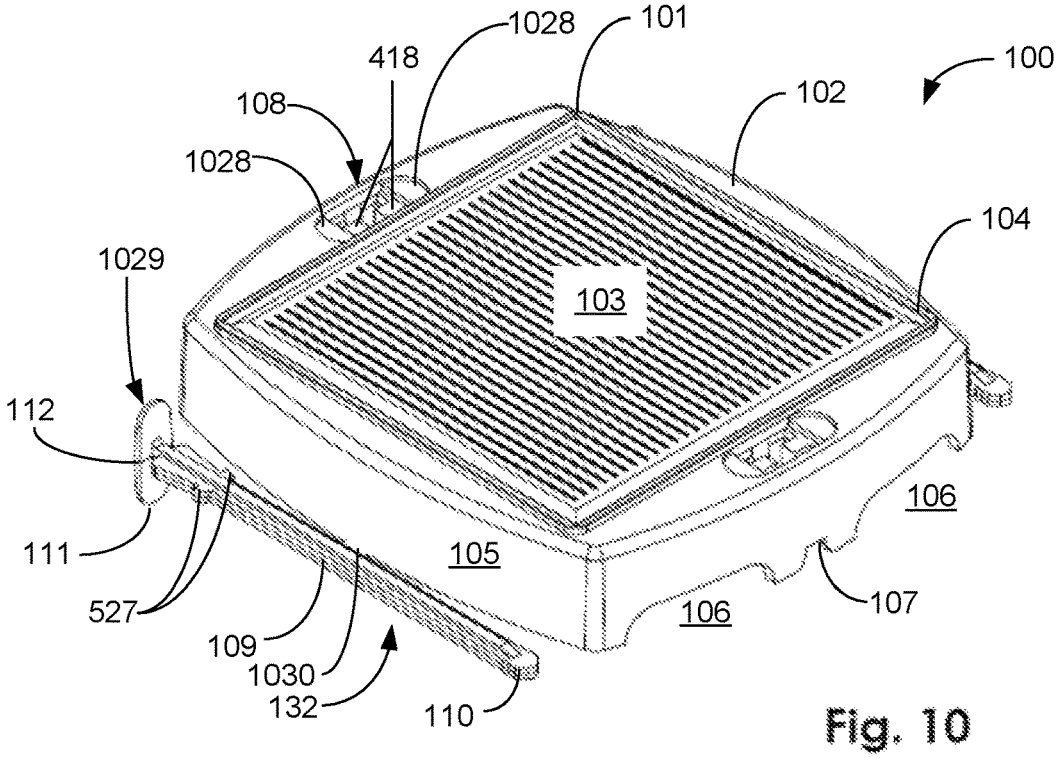
FIG. 10 is a top perspective view of a solar light assembly as packaged for shipment in accordance with an embodiment of the present disclosure.

FIG. 10 is a top perspective view of an embodiment of the solar light assembly 100 shown in FIG. 1 as the assembly is packaged for users. The spear 109 comprises the spear tip 110 and a spear top 1029 disposed at opposite ends of the spear 109. A spear tab 111 is positioned on the spear 109 proximate the spear top 1029. In some embodiments of the housing 101, the slot 108 may comprise a slot step 1028. The slot step 1028 may be a shelf or depression configured to receive and support the spear tab 111 without interrupting the slot 108 receiving the spear 109.

In the embodiment of FIG. 10, the sign-attachment component 132 (e.g., the spear 109) is attached to the housing 101 by at least one attachment tab 1030. The attachment tab 1030 may be a separable attachment of the spear 109 to the housing 101. For example, the attachment tab 1030 may be a piece of plastic which may be broken by either a user or an assembling machine. An attachment tab 1030 which holds a spear 109 substantially in the plane of the housing 101 may allow the solar light assembly 100 to fit within a smaller hull for packing and shipping. Before using the solar light assembly 100, a user or assembling machine may then separate the spear 109 from the housing 101 (for example by breaking, cutting, or tearing the attachment tab 1030) before the housing 101 receives the spear 109. In some embodiments, the attachment tab 1030 may be reversibly separable, so that, after use, the sign-attachment component 132 may be reattached to the housing 101 for stowage.

The spears 109 and attachment tabs 1030 may be formed by molding them along the sides of the housing 101 in the same mold and left attached to the housing 101. In some embodiments this may prevent the spears 109 from being lost before a user uses the solar light assembly.

Figure 11:
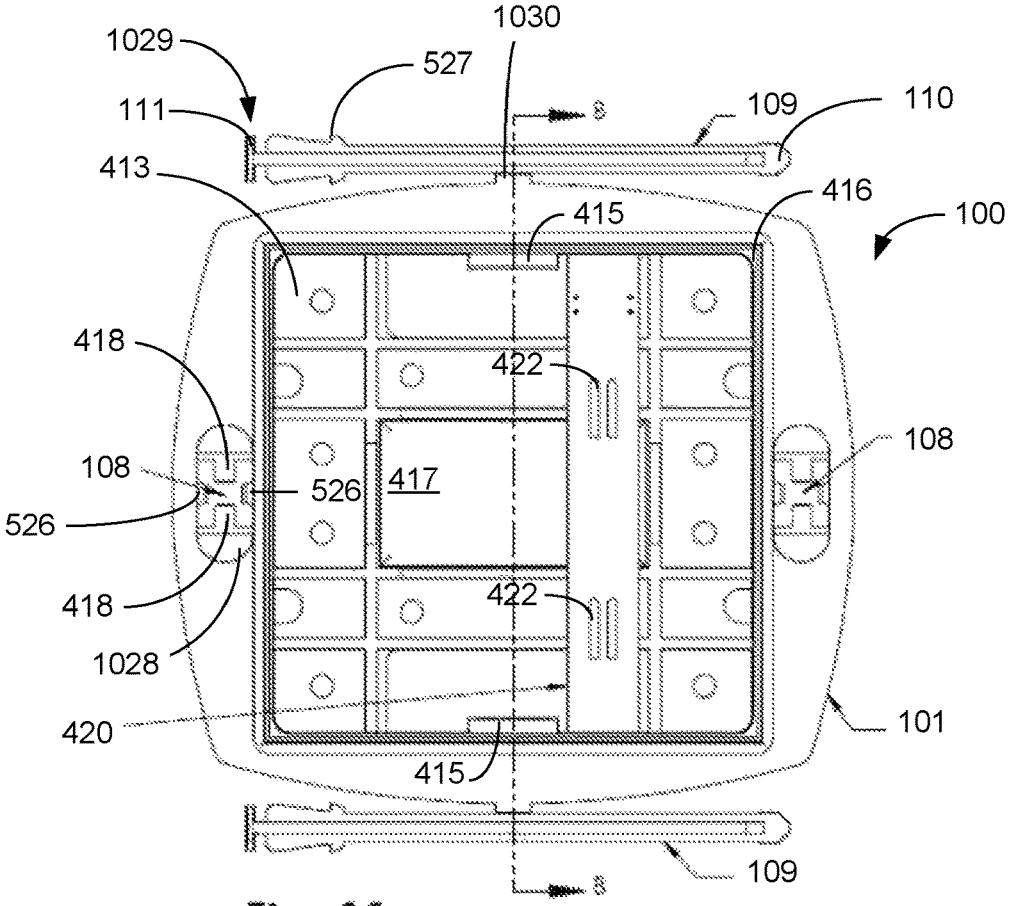
FIG. 11 is a top view of the solar light assembly of FIG. 10, without the solar panel.

FIG. 11 is a top view of the solar light assembly 100 of FIG. 10 without the solar panel 103 (FIG. 10) or battery 419 (FIG. 4) installed and before the PCB 420 has been fit under the retaining features 415. As shown in the illustrated embodiment, the retaining features 415 do not extend along the entire longitudinal length of the cavity wall 414.

The attachment tabs 1030 affix the spears 109 to the housing 101 as discussed above. The battery recess 417 is molded into the housing 101 and receives the battery 419 (FIG. 4).

The slot 108 is configured to receive the spear 109 as discussed herein. A pair of buttresses 418 on opposed sides of the slot 108 are molded into the housing 101 and constrain the spears 109 tightly in the transverse direction so that the light (not shown) will not wobble side to side with respect to the spears 109, which are engaged tightly within the sign when installed. These buttresses 418 are molded with the distal ends slightly closer together to interfere slightly with the spears 109 so that there is no clearance transversely between the spear 109 and the housing 101, as further seen in FIGS. 16 and 17. Also, these buttresses 418 prevent the spears 109 from being inserted 90 degrees out of clocking alignment, as the spears 109 are thicker in the longitudinal direction than they are in the transverse direction, so they will only fit through the slot 108 in the correct way.

The spears 109 are further retained in place when fully inserted by two opposing spring fingers 526 arranged longitudinally in the housing on each side of the cavity for the spears. These fingers 526 are shaped to be able to flex outwardly to enable the catch spear ears 527 on each longitudinal side of the spear 109 to pass between them as the user presses the spears through the slot into place.

Figure 12:
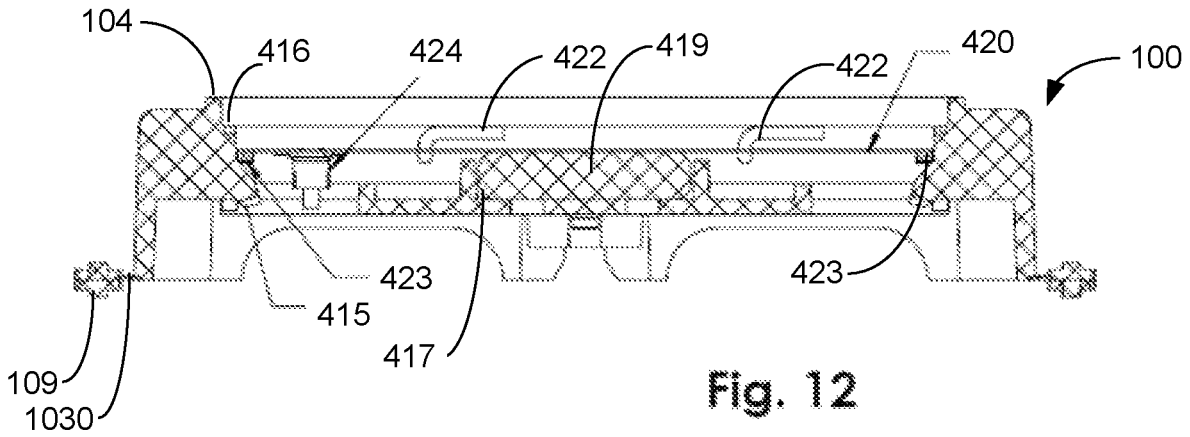
FIG. 12 is a cross-sectional view of the solar light assembly of FIG. 11, taken along lines B-B of FIG. 11.

FIG. 12 is a cross-sectional view of the solar light assembly 100 of FIG. 11, taken along lines B-B of FIG. 11, before the PCB 420 is flexed.

Figure 13:
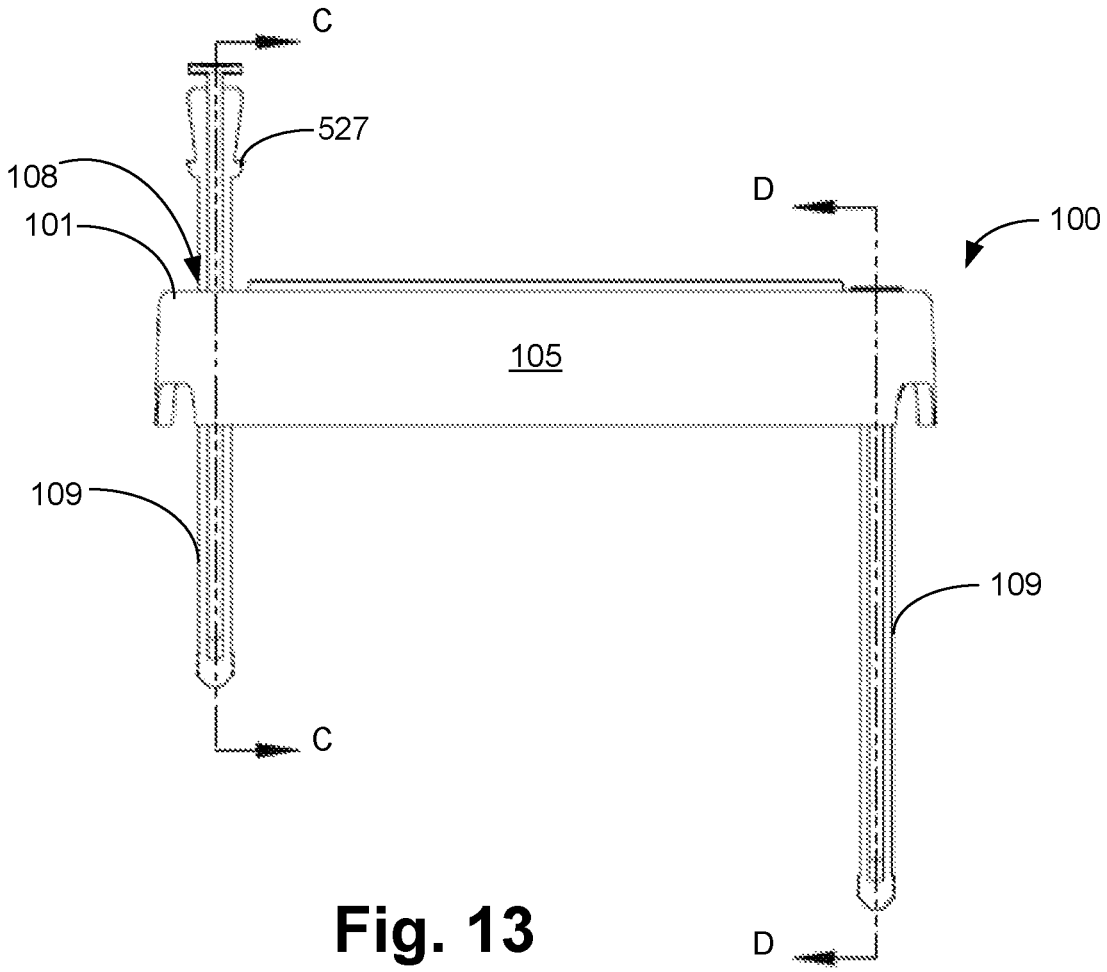
FIG. 13 is a side view of a solar light assembly in accordance with an embodiment of the present disclosure.

FIG. 13 is a side view of the solar light assembly 100 of FIG. 1, with the spear 109 on the left side partially inserted into the slot 108. The spear 109 on the right side is shown substantially fully inserted into the slot 108.

Figure 14:
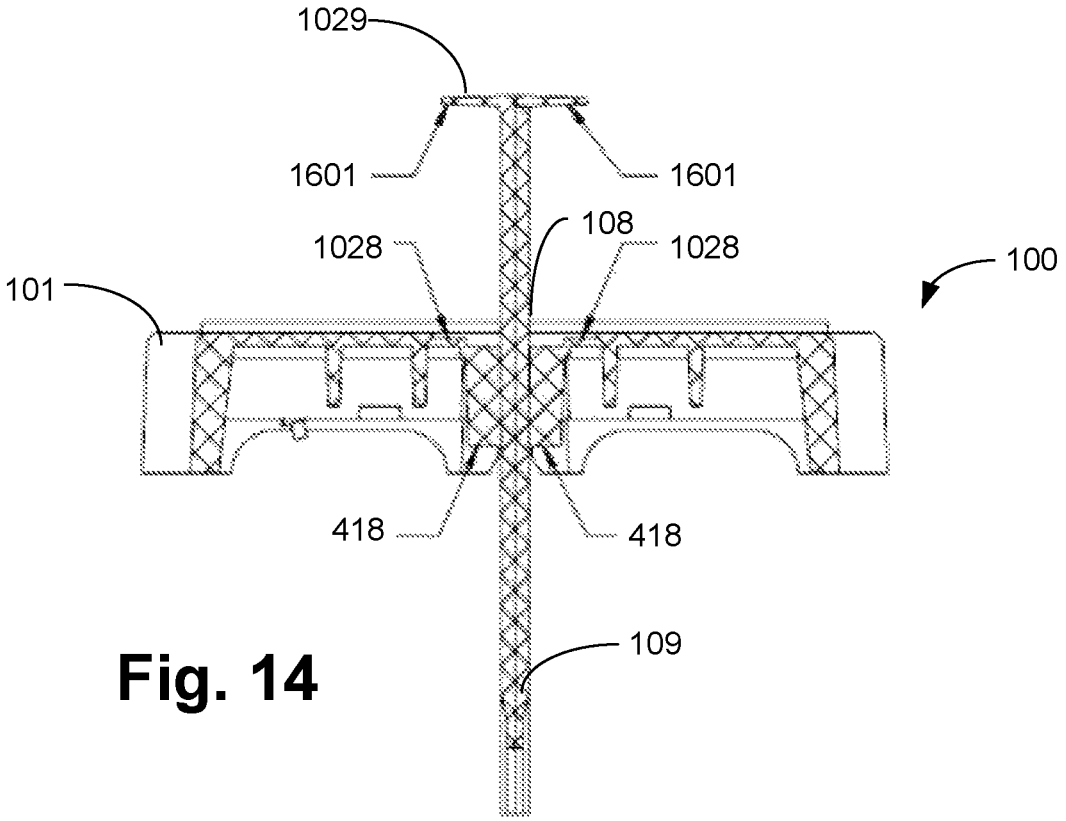
FIG. 14 is a cross-sectional view of the solar light assembly of FIG. 13, taken along lines C-C of FIG. 13.

FIG. 14 is a cross-sectional view of the solar light assembly of FIG. 13, taken along lines C-C of FIG. 13. In the embodiment shown, the pair of slot buttresses 418 is configured such that their distal ends are slightly closed together. The slot buttresses 418 contact and interfere slightly with the spear 109, so that there is little or no transverse clearance between the spear 109 and the housing 101.

The spear top 1029 has a wide, thin oval shape with long sides 1601 in the transverse direction. These sides 1601 are placed to engage with a slot step 1028 on each side transversely of the slot 108 that the spear 109 is inserted into. The top 1029 of the spear 109 has some flexibility and functions as a spring when engaged in the slot against the slot steps 1028. This spring action is used to eliminate vertical clearance between the ends of the spring fingers 526 (FIG. 11) and the ears 527 (FIG. 11) when the spears 109 are fully inserted, as the user must push the spears deep enough into the slot 108 to flex the top 1029 down before the tips of the spring fingers 526 snap over the ears 527. When the insertion force is removed, a small amount of elastic deformation remains in the spear top 1029, which serves to eliminate vertical clearance. Also of note, the spring fingers 526 in combination with the flexibility of the spear top 1029 are flexible enough to allow the spears 109 to be rotated slightly relatively easily in the longitudinal plane, which is important to allow the spears to adjust to the spacing of the corrugations of the sign which can vary between signs made by different makers.

Figure 15:
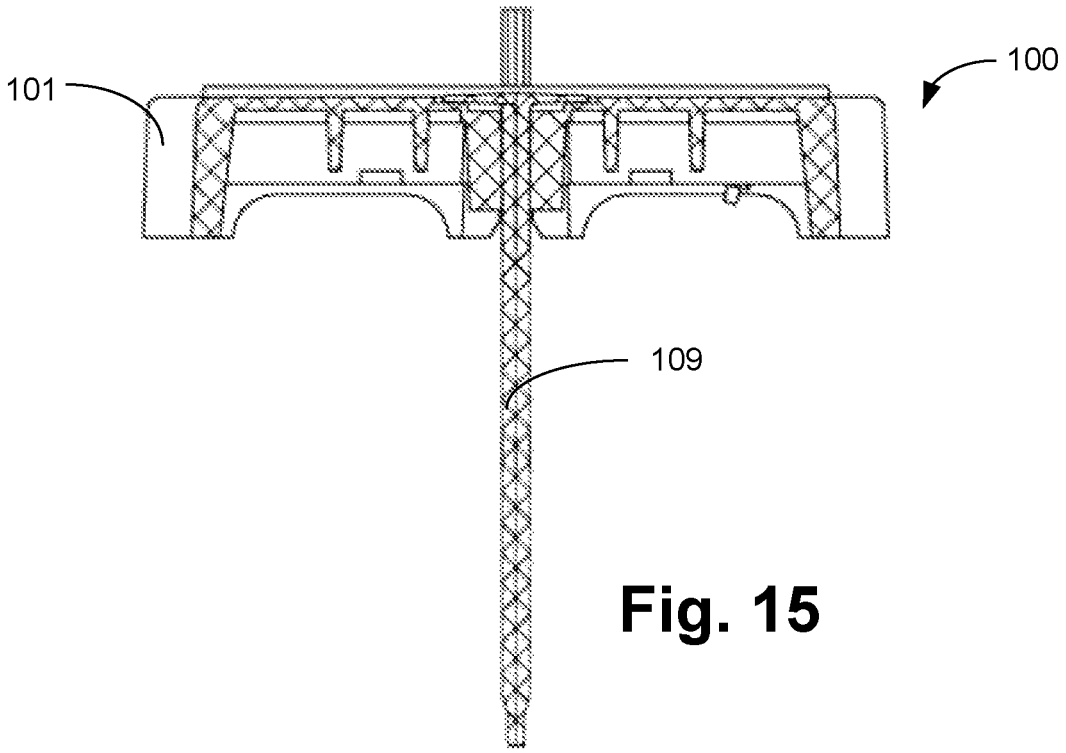
FIG. 15 is a cross-sectional view of the solar light assembly of FIG. 13, taken along lines D-D of FIG. 13.

FIG. 15 is a cross-sectional view of the solar light assembly of FIG. 13, taken along lines D-D of FIG. 13.

Figure 16:
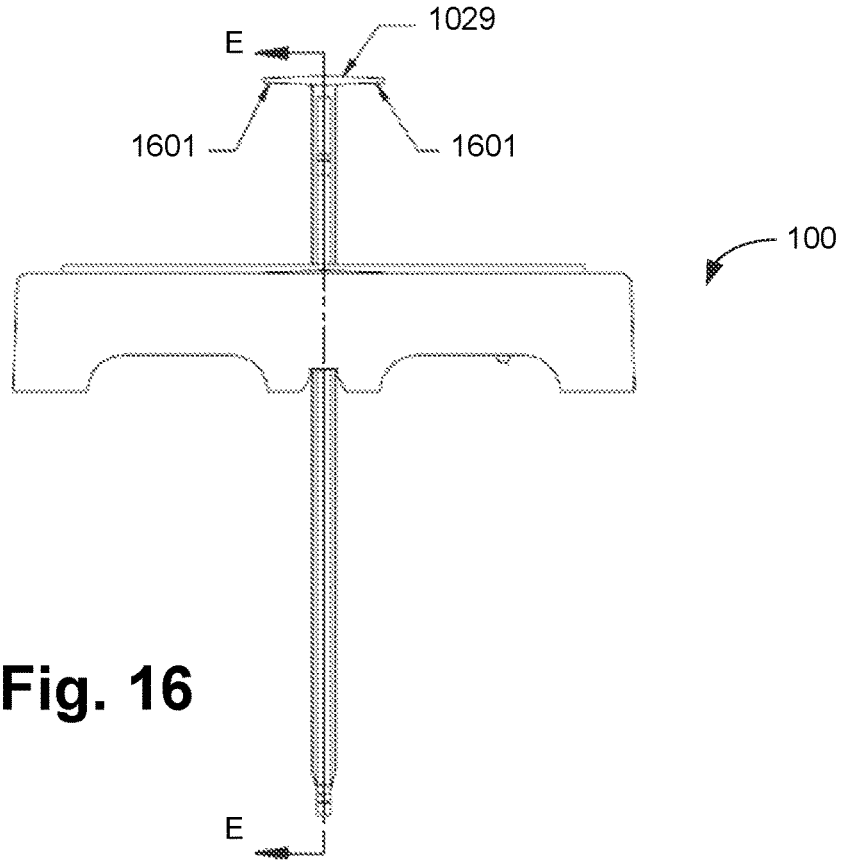
FIG. 16 is a side view of a solar light assembly in accordance with an embodiment of the present disclosure.

FIG. 16 is a side view of the solar light assembly 100 of FIG. 15 with the spear 109 partially inserted into the housing 101.

Figure 17:
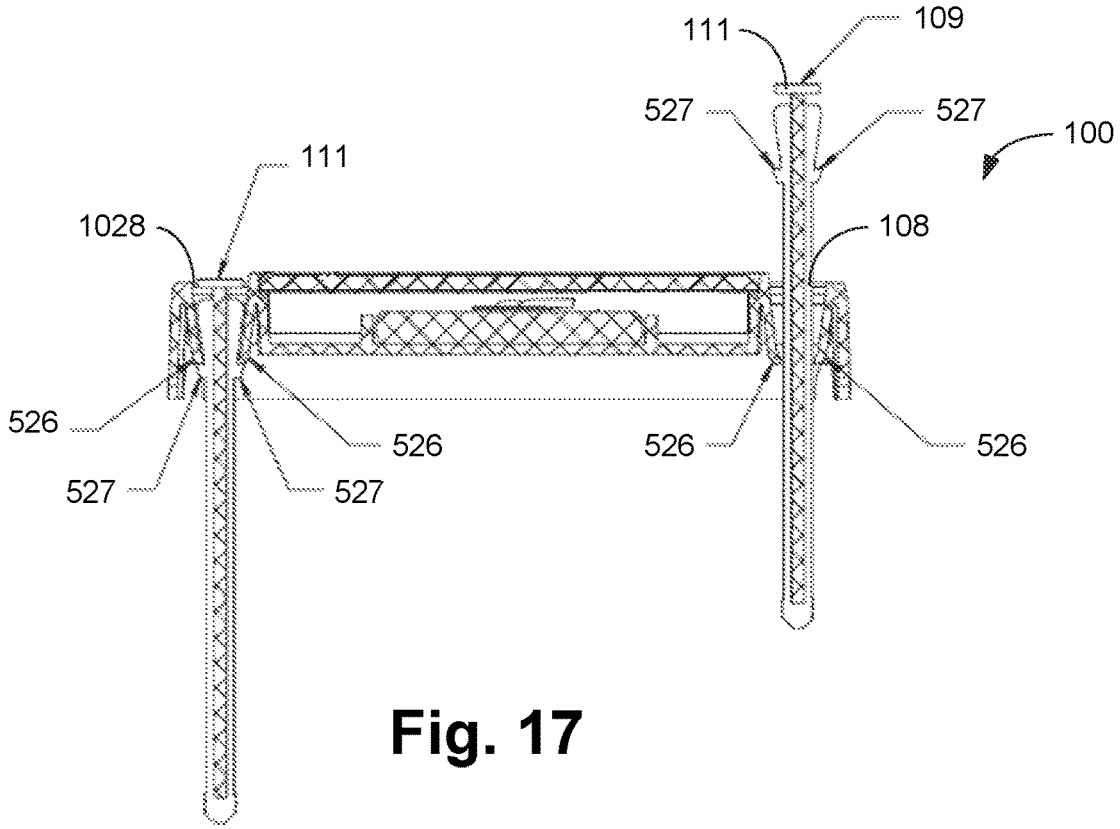
FIG. 17 is a cross-sectional view of the solar light assembly of FIG. 16, taken along lines E-E of FIG. 16.

FIG. 17 is a cross-sectional view of the solar light assembly 100 of FIG. 16, taken along lines E-E of FIG. 16. FIG. 17 shows an embodiment of the spear 109 and the slot 108 with the spear ears 527, spear tab 111, and slot spring fingers 526 as described above. The right-side spear 109 in FIG. 17 is partially inserted into the right-side slot 108, but not far enough for its spear ears 527 to engage the slot spring fingers 526. The left-side spear 109 in FIG. 17 is fully inserted into the right-side slot 108: its spear tab 111 is being supported by the slot step 1028; the elastic flexure of its spear tab 111 is applying an upwardly vertical force to the spear 109; and its spear ears 527 are engaging the slot spring fingers 526 such that the slot spring fingers 526 prevent the spear 109 from moving upwardly vertically through the slot 108.

In other embodiments, the spear ear 527 may be any projection, indentation, or combination of projections and indentations configured to retain the spear 109 in the slot 108. The slot 108 may comprise at least one slot spring finger 526. The at least one slot spring finger 526 may be configured to catch the at least one spear ear 527 when the slot 108 receives the spear 109. The slot spring fingers 526 may be configured to elastically and reversibly flex outward receive the spear 109 and to reflex inward to catch the spear ears 527. For example, as shown in FIG. 5, a pair of slot spring fingers 526 may be disposed opposite each other across the slot 108 across the longitudinal direction and configured to catch a pair of spear ears 527 disposed opposite each other across the longitudinal direction of the spear 109 when oriented to be received by the slot 108.

For example, the slot step 1028 may support a spear tab 111 at a pair of transverse ends of the spear tab 111 while not supporting the spear tab 111 beneath the center portion 112 of the spear tab 111. In such an embodiment, when a downwardly vertical force is applied (e.g., by a user or by an assembling machine) to the center portion 112 of the spear tab 111, the center portion 112 may elastically and reversibly flex downward from the rest of the spear tab 111. Such flexure may allow a spear ear 527 to travel downward past a slot spring finger 526. Then, when the downwardly vertical force is released, the elastic restoring force of the spear tab 111 may pull the spear ear 527 upwardly vertically against the bottom of the slot spring finger 526. The resulting contact force 1931 may prevent the spear 109 from returning upwardly vertically through the slot 108, for instance while the spear 109 is being inserted into a flute (not shown in FIG. 17) of a corrugated sign (not shown in FIG. 17).

While the foregoing specification has described specific embodiments of this invention and many details have been put forth for the purpose of illustration or example, it will be apparent to one skilled in the art that the invention is susceptible to additional embodiments and that certain of the details described herein can be varied considerably without departing from the basic principles of the invention.

What is claimed is:

1. A solar light assembly for illuminating a corrugated sign, comprising:
- a solar panel;
- a battery electrically connected to the solar panel;
- a printed circuit board electrically connected to the solar panel and to the battery;
- at least one light electrically connected to the battery and to the printed circuit board;
- a sign-attachment component configured to be attached to the corrugated sign; and
- a housing configured to receive the solar panel, the battery, the printed circuit board, the at least one light, and the sign-attachment component.

2. The solar light assembly of claim 1, wherein the housing further comprises:
- a cavity configured to receive the battery and the printed circuit board, the cavity comprising a cavity wall;
- wherein the cavity wall further comprises at least one retaining feature configured to retain the printed circuit board in the cavity, and
- wherein the cavity wall further comprises a cavity step configured to support the solar panel proximate the top surface.

3. The solar light assembly of claim 2, wherein the cavity, the cavity wall, and the at least one retaining feature are configured to retain the printed circuit board in a curved state.

4. The solar light assembly of claim 3, wherein the curved state of the printed circuit board causes a centerline of illumination from the light to project onto a print surface of the corrugated sign.

5. The solar light assembly of claim 3, wherein the curved state of the printed circuit board applies a force to the battery to retain the battery within a battery recess.

6. The solar light assembly of claim 3, wherein the curved state of the printed circuit board causes a centerline of illumination from the light to angle between 5 and 45 degrees toward a print surface of the corrugated sign.

7. The solar light assembly of claim 1, wherein the sign-attachment component comprises at least one spear configured to be inserted into the flute of a corrugated sign.

8. The solar light assembly of claim 7, wherein each spear comprises:
- a spear top;
- a spear tip;
- at least one spear ear; and
- wherein the housing further comprises at least one slot, wherein each slot is configured to receive a spear.

9. The solar light assembly of claim 8, wherein each slot is configured to retain a spear by at least one slot spring finger, wherein the slot spring fingers are configured to catch the at least one spear ear.

10. The solar light assembly of claim 7, wherein the housing further comprises a tapered notch configured to be inserted into the corrugated sign in an interference fit.

11. The solar light assembly of claim 7, wherein each spear is separably attached to the housing by an attachment tab.

12. The solar light assembly of claim 8, wherein each slot further comprises a slot step;
- wherein each spear further comprises a spear tab proximate the spear top; and
- wherein each slot step is configured to support a spear by the spear tab such that when the spear tab is pressed into the slot, a center portion of the spear tab flexes downward which tenses the spear to create a contact force of the spear ear upward against the slot spring fingers.

13. The solar light assembly of claim 2, wherein the housing further comprises a raised rib that extends above the solar panel when the solar panel is supported on the cavity step.

14. The solar light assembly of claim 13, wherein the housing further comprises a skirt.

15. The solar light assembly of claim 14, wherein the skirt comprises at least one cutout configured to allow illumination from the at least one light to reach the corrugated sign beyond a perimeter of the housing.

16. The solar light assembly of claim 1, further comprising a manual switch connected to the printed circuit board.

17. The solar light assembly of claim 1, wherein each light is a light-emitting diode.

18. A solar light assembly for illuminating a sign, comprising:

a solar panel;

a battery electrically connected to the solar panel;

a printed circuit board electrically connected to the solar panel and the battery, the printed circuit board comprising at least one light;

the printed circuit board curved to cause a centerline of illumination of the light to angle towards a printed surface of the sign; and a sign-attachment component configured attach the solar panel and the printed circuit board to the corrugated sign.

19. The solar light assembly of claim 18, wherein the flexed state of the printed circuit board causes the centerline of illumination to angle between 5 and 45 degrees toward the printed surface of the sign.

20. The solar light assembly of claim 18, wherein the sign-attachment component comprises at least one spear configured to be inserted into a flute of a corrugated sign.

* * * * *